US008371144B1

(12) United States Patent
Pai

(10) Patent No.: US 8,371,144 B1
(45) Date of Patent: Feb. 12, 2013

(54) LOOP FORMING AND LOOSENING MECHANISM AND SINKERS THEREOF FOR CIRCULAR KNITTING MACHINES

(75) Inventor: Tieh-Hsiung Pai, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 0 days.

(21) Appl. No.: 13/238,756

(22) Filed: Sep. 21, 2011

(51) Int. Cl.
*D04B 27/04* (2006.01)

(52) U.S. Cl. ..... 66/107; 66/93

(58) Field of Classification Search ..... 66/19, 31, 66/32, 91, 92, 93, 104, 107, 108 R, 108 A
See application file for complete search history.

(56) References Cited

U.S. PATENT DOCUMENTS 3,377,823 A * 4/1968 McDonough ..... 66/115
3,540,237 A * 11/1970 Agulnek ..... 66/107
3,817,058 A * 6/1974 Lombardi ..... 66/8
3,986,371 A * 10/1976 Havranek et al. ..... 66/107
4,180,993 A * 1/1980 Philip ..... 66/107
4,535,608 A * 8/1985 Plath et al. ..... 66/9 R
5,010,744 A * 4/1991 Kawase et al. ..... 66/93
5,048,313 A * 9/1991 Vignoni ..... 66/141

* cited by examiner

*Primary Examiner* — Danny Worrell
(74) *Attorney, Agent, or Firm* — Muncy, Geissler, Olds & Lowe, PLLC

(57) ABSTRACT

A sinker includes a sliding segment with a sliding portion slidably located in a sinker groove, a loop forming and loosening ancillary segment extended upwards from one side of the sliding portion and then extended outwards, a passive segment located above the sliding segment and driven by a cam, and an indented abrasion-reducing space located at a lateral side of the sliding portion and below the loop forming and loosening ancillary segment. Through the abrasion-reducing space, the loop forming and loosening ancillary segment can move directly and horizontally above a needle cylinder. The loop forming and loosening mechanism for circular knitting machines of the invention can simplify fabrication of the needle cylinder, reduce labor and material costs, improve quality and production yield of the needle cylinder, and also reduce abrasion of the sinker, thus can improve performance of the mechanism and enhance lifespan of the sinker.

12 Claims, 6 Drawing Sheets

LOOP FORMING AND LOOSENING MECHANISM AND SINKERS THEREOF FOR CIRCULAR KNITTING MACHINES

FIELD OF THE INVENTION

The present invention relates to a mechanism and elements of circular knitting machines and particularly to a mechanism and sinkers thereof for a circular knitting machine to aid knitting needles in loop forming and loosening.

BACKGROUND OF THE INVENTION

A conventional loop forming and loosening mechanism 1*a* of a circular knitting machine, referring to FIGS. 1 and 2, includes a needle cylinder 4*a* to hold a plurality of needles 5*a* located vertically, a plurality of correcting troughs 41 above the needle cylinder 4*a*, a sinker tray 10*a* located at the circumference of the needle cylinder 4*a* with a plurality of horizontal sinker grooves 11*a* formed thereon each holding a sinker 3*a*, and a cam holder 2*a* located above the sinkers 3*a* to hold a plurality of cams 20*a*. The cams 20*a* aim to drive the sinkers 3*a* to move reciprocally and horizontally. Each sinker 3*a* includes a sliding segment 31*a* with a sliding portion 310*a* slidably located in one sinker groove 11*a*, a loop forming and loosening ancillary segment 32*a* extended upwards from one side of the sliding portion 310*a* and then extended outwards and including a horizontal and indented yarn pressing notch 320*a* to aid each needle 5*a* in loop forming and loosening, a passive segment 30*a* located above the sliding segment 31*a* and driven by the cam 20*a* with a protrusion 300*a* extended upwards from the sliding portion 310*a*, and a correcting segment 34 extended downwards from the loop forming and loosening ancillary segment 32*a*. The correcting segment 34 is inserted and confined in one correcting trough 41 to aid each needle 5*a* to accurately form or loosen a loop. Hence when the sinker 3*a* is moved reciprocally and horizontally the left and right lateral sides and bottom side of the correcting segment 34 generate contact friction due to confinement of the correcting trough 41.

In short, although the conventional technique can aid the needle to form or loosen loops, it still has drawbacks in practice, notably:

1. Each sinker 3*a* of the conventional loop forming and loosening mechanism 1*a* of the circular knitting machine has a correcting segment 34, hence the needle cylinder 4*a* has to form a plurality of correcting troughs 41 thereon during fabrication. This creates structural complexity of the needle cylinder 4*a* and makes fabrication more difficult. The quality and production yield of the needle cylinder 4*a* decrease, and material and labor costs increase.

2. When the sinker 3*a* moves reciprocally and horizontally the correcting segment 34 also moves reciprocally and constantly in the correcting trough 41 that produces a lot of contact friction. This generates high temperature on the sinker 3*a* during long time of operation, and significant wearing or deformation could happen that shortens the lifespan of the sinker 3*a*. Moreover, loading of electric power also increases and performance of the loop forming and loosening mechanism 1*a* suffers. The entire knitting environment also could be contaminated.

SUMMARY OF THE INVENTION

The primary object of the present invention is to solve the aforesaid disadvantages by providing a loop forming and loosening mechanism for circular knitting machines to simplify fabrication of needle cylinder, reduce labor and material costs, improve quality and production yield of the needle cylinder, reduce abrasion of sinkers, enhance performance of the mechanism and increase lifespan of the sinkers.

To achieve the foregoing object, the loop forming and loosening mechanism according to the invention includes a needle cylinder to hold a plurality of needles located vertically, a sinker tray located at the circumference of the needle cylinder with a plurality of horizontal sinker grooves formed thereon each holding a sinker, and a cam holder located above the sinkers to hold a plurality of cams. Each cam has a first guide track and a second guide track to drive the sinkers to move horizontally. Each sinker includes a sliding segment with a sliding portion slidably located in each sinker groove, a loop forming and loosening ancillary segment extended upwards from one side of the sliding portion and then extended outwards and including a horizontal and indented yarn pressing notch to aid the needle to form or loosen loops that includes a first ancillary edge and a second ancillary edge respectively at an upper side and a lower side, a passive segment located above the sliding segment and driven by the cam with a protrusion extended upwards from the sliding portion and spaced from the loop forming and loosening ancillary segment, and an indented abrasion-reducing space located at a lateral side of the sliding portion and below the loop forming and loosening ancillary segment. Through the abrasion-reducing space, the loop forming and loosening ancillary segment can move directly and horizontally above the needle cylinder.

In one aspect the sinker has a threshold edge at a boundary between a lower side of the loop forming and loosening ancillary segment and an upper side of the abrasion-reducing space. The threshold edge is preferably forming a gap with the needle cylinder.

In another aspect the protrusion has a shrunk guiding side opposing to one lateral side of the loop forming and loosening segment, and the loop forming and loosening segment has an extended guiding side opposing to one lateral side of the protrusion; the first guide track faces the shrunk guiding side, and the second guide track faces the extended guiding side.

In yet another aspect the loop forming and loosening mechanism has a yarn feeding aperture suspended above the sinkers which are located between the needles and cam holder.

To achieve the foregoing object, the invention also provides a sinker for circular knitting machines that includes a sliding segment with a sliding portion, a loop forming and loosening ancillary segment extended upwards from one side of the sliding portion and then extended outwards and including a horizontal and indented yarn pressing notch which has a first ancillary edge and a second ancillary edge respectively at an upper side and a lower side, a passive segment located above the sliding segment with a protrusion extended upwards from the sliding portion and spaced from the loop forming and loosening ancillary segment, and an indented abrasion-reducing space located at a lateral side of the sliding portion and below the loop forming and loosening ancillary segment.

In one aspect the sinker has a threshold edge at a boundary between a lower side of the loop forming and loosening ancillary segment and an upper side of the abrasion-reducing space.

In another aspect the protrusion has a shrunk guiding side opposing to one lateral side of the loop forming and loosening segment, and the loop forming and loosening segment has an extended guiding side opposing to one lateral side of the protrusion.

By means of the features set forth above, compared with the conventional techniques the invention provides many benefits, notably:

1. Due to the sinker has an indented abrasion-reducing space, there is no need to fabricate a plurality of correcting troughs on the needle cylinder, hence fabrication process of the needle cylinder is simplified, and labor and material costs can be reduced, and the quality and production yield of the needle cylinder improve.

2. Because the sinker has an indented abrasion-reducing space, it does not have the problem of inserting into the correcting trough of the needle cylinder during horizontal movement, hence wearing of the sinker can be reduced and the performance of the mechanism and lifespan of the sinker also can be enhanced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
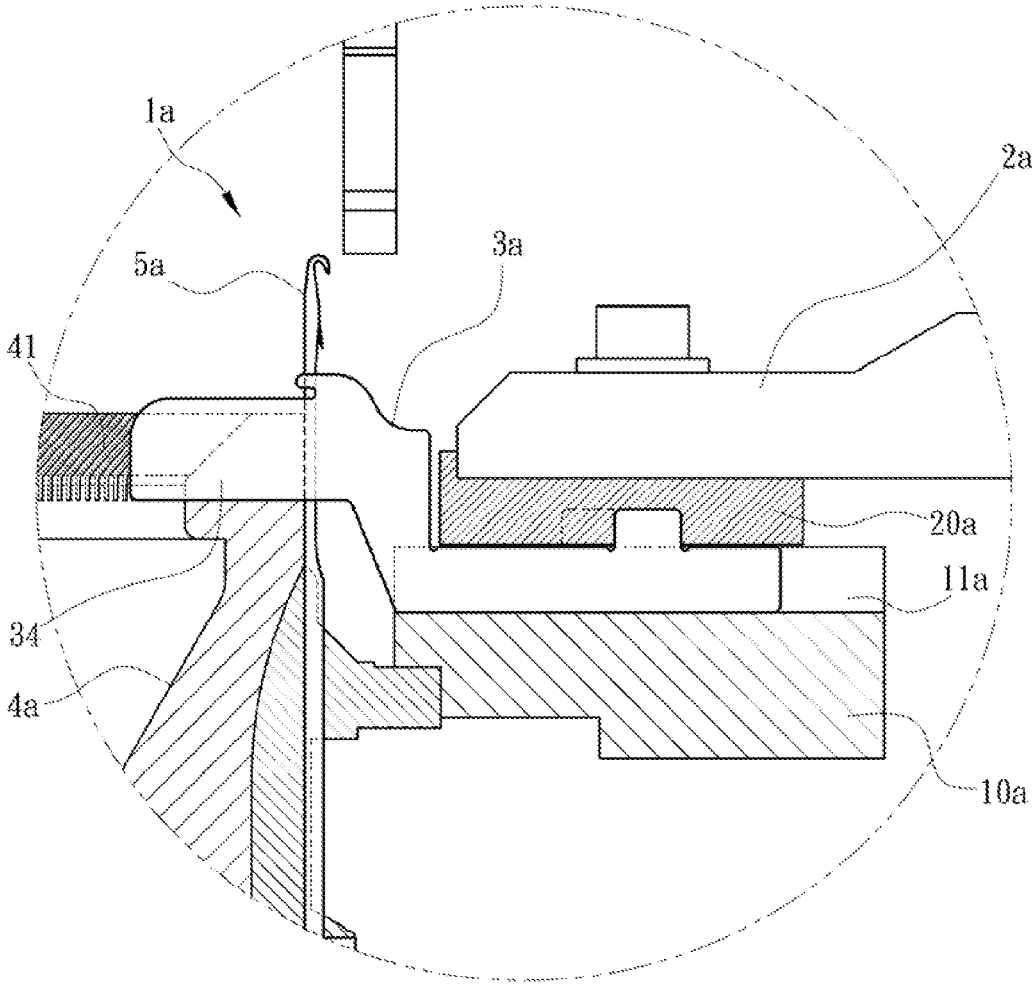
Fig. 1 PRIOR ART
FIG. 1 is a plane view of a conventional technique.
Figure 2:
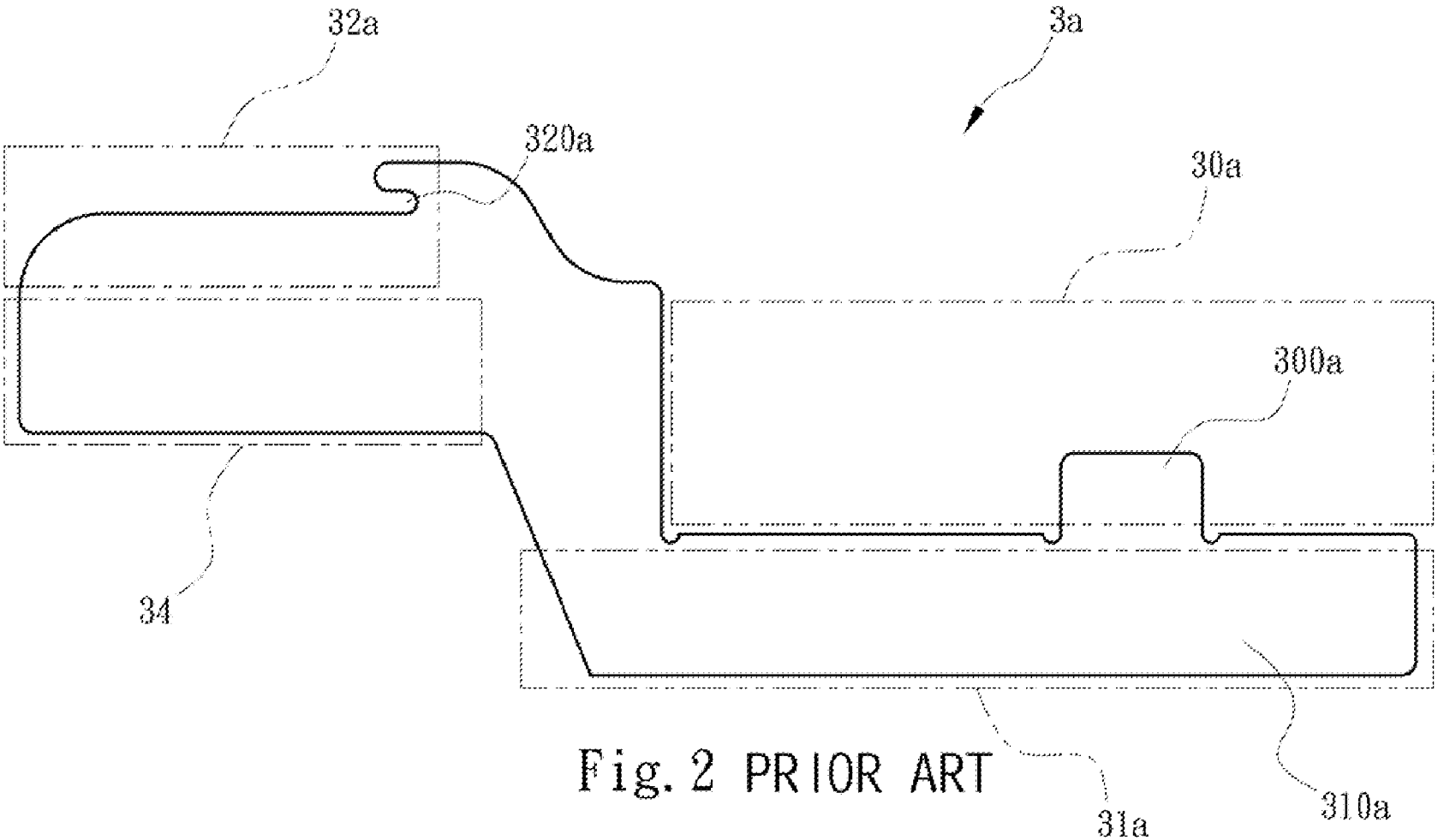
Fig. 2 PRIOR ART
FIG. 2 is a plane view of a sinker according to FIG. 1.
Figure 3:
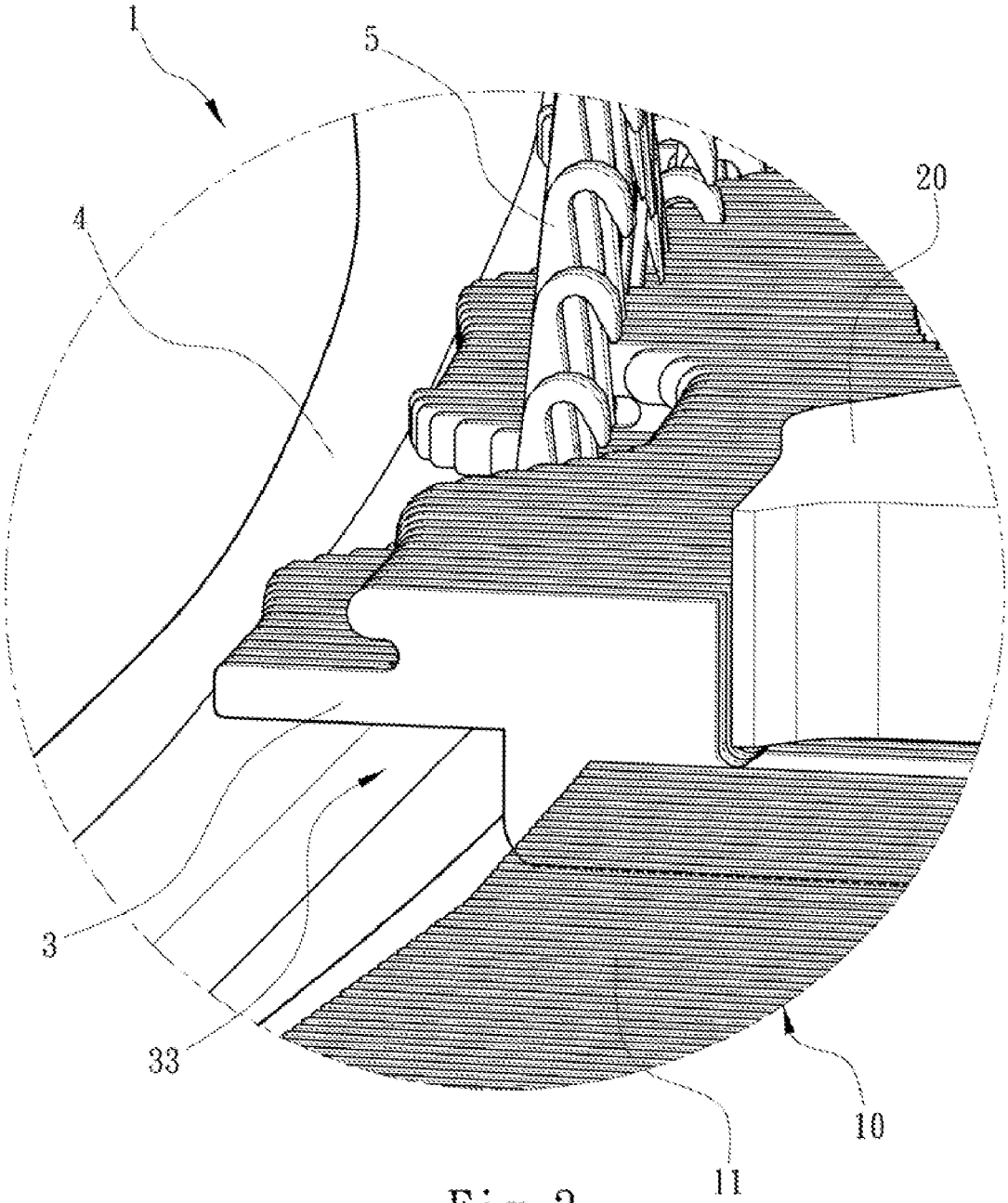
FIG. 3 is a fragmentary perspective view of an embodiment of the invention.
Figure 4:
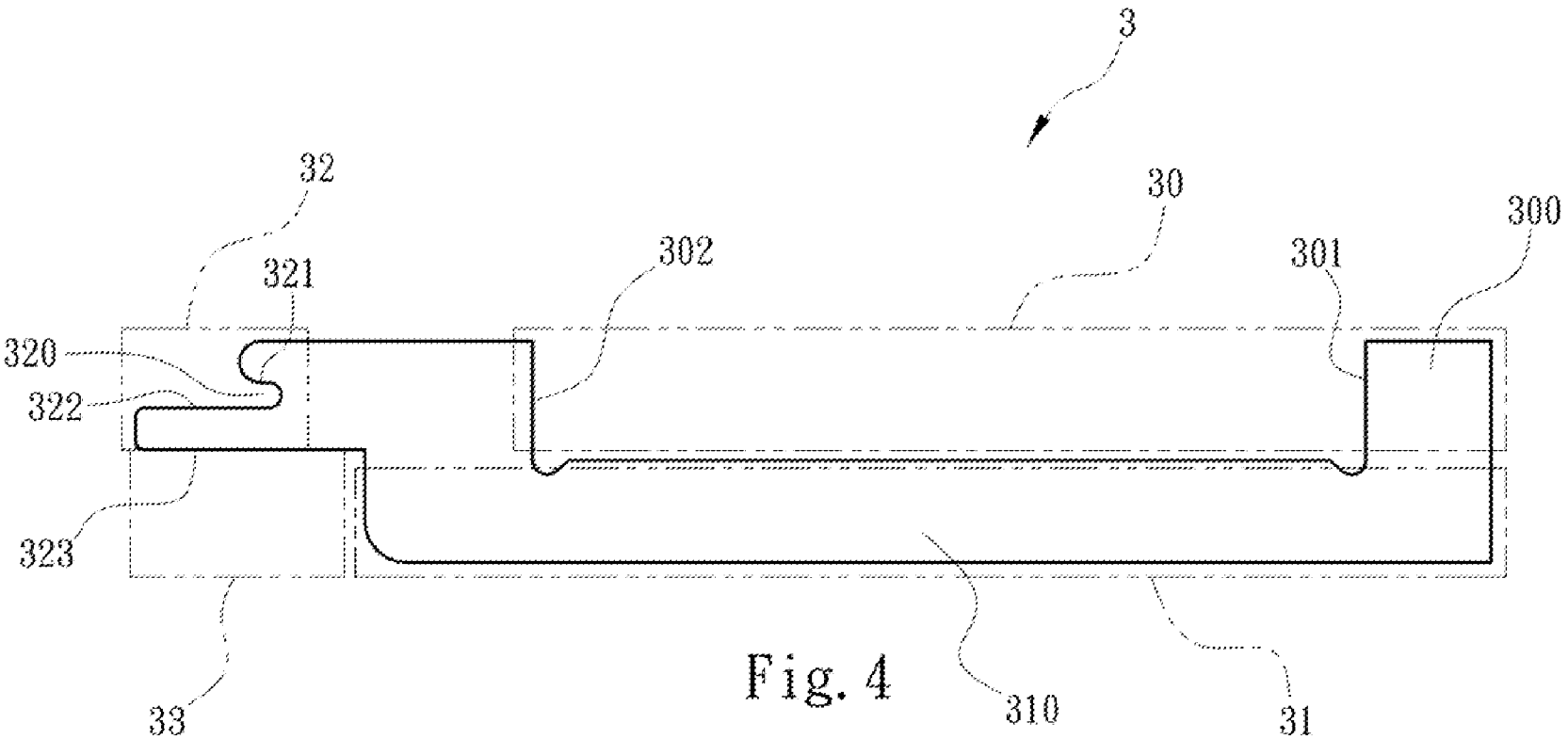
FIG. 4 is a plane view of a sinker according to FIG. 3.
Figure 5:
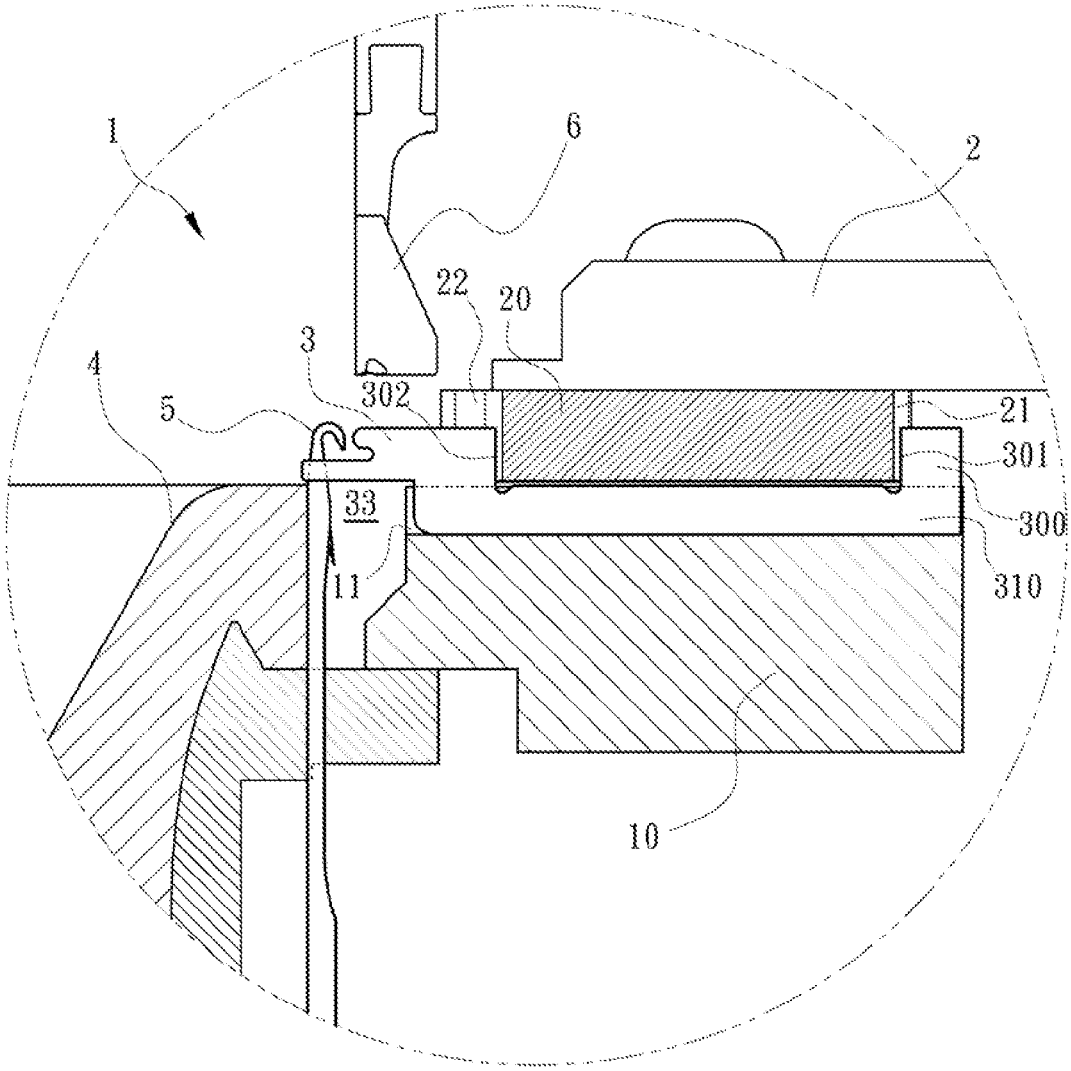
FIG. 5 is a plane view of the invention according to FIG. 3.

Please refer to FIGS. 3 through 5, the present invention aims to provide a loop forming and loosening mechanism 1 for circular knitting machines. It includes a needle cylinder 4 to hold a plurality of needles 5 located vertically, a sinker tray 10 located at the circumference of the needle cylinder 4 with a plurality of horizontal sinker grooves 11 formed thereon each holding a sinker 3, and a cam holder 2 located above the sinkers 3 to hold a plurality of cams 20. Each cam 20 has a first guide track 21 and a second guide track 22 to drive the sinkers 3 to move horizontally. The present invention further provides features as follows: each sinker 3 includes a sliding segment 31 with a sliding portion 310 slidably located in one sinker groove 11, a loop forming and loosening ancillary segment 32 extended upwards from one side of the sliding portion 310 and then extended outwards and including a yarn pressing notch 320 indented horizontally to aid each needle 5 to form or loosen loops that includes a first ancillary edge 321 and a second ancillary edge 322 respectively at an upper side and a lower side, a passive segment 30 located above the sliding segment 31 and driven by the cam 20 with a protrusion 300 extended upwards from the sliding portion 310 and spaced from the loop forming and loosening ancillary segment 32, preferably extended upwards from another side of the sliding portion 310, and an indented abrasion-reducing space 33 located at a lateral side of the sliding portion 310 and below the loop forming and loosening ancillary segment 32. Through the abrasion-reducing space 33, the loop forming and loosening ancillary segment 32 can move directly and horizontally above the needle cylinder 4. The sinker 3 has a threshold edge 323 at a boundary between a lower side of the loop forming and loosening ancillary segment 32 and an upper side of the abrasion-reducing space 33. The threshold edge 323 is preferably spaced from the needle cylinder 4 by a gap, i.e. the threshold edge 323 may also touch the upper edge of the needle cylinder 4 while it is moved horizontally. As the sinker 3 is formed in a blade, when the threshold edge 323 touches the upper edge of the needle cylinder 4 during the horizontal movement the resulting contact forms a much smaller friction surface than the conventional technique does. Moreover, the protrusion 300 has a shrunk guiding side 301 opposing to one lateral side of the loop forming and loosening ancillary segment 32, and the loop forming and loosening ancillary segment 32 has an extended guiding side 302 opposing to one lateral side of the protrusion 300. The first guide track 21 faces the retracted guiding side 301, while the second guide track 22 faces the forward extended guiding side 302. Of course, the forward extended guiding side 302 may also be formed on another lateral side of the protrusion 300, namely, as long as it faces the second guide track 22. Finally, a yarn feeding aperture 6 is provided to suspend above the sinkers 3 which are located between the needles 5 and cam holder 2 to continuously feed a yarn (not shown in the drawings) to the needles 5 and sinkers 3 to perform knitting operation. Thus the loop forming and loosening mechanism of the invention can simplify fabrication of the needle cylinder, reduce labor and material costs, improve quality and production yield of the needle cylinder, and also reduce abrasion of the sinkers. All these can enhance the performance of the mechanism and increase lifespan of the sinkers.

Referring to FIG. 4, the present invention also provides a sinker for circular knitting machines. The sinker 3 includes a sliding segment 31 which has a sliding portion 310, a loop forming and loosening ancillary segment 32 extended upwards from one side of the sliding portion 310 and then extended outwards and including a yarn pressing notch 320 indented horizontally that includes a first ancillary edge 321 and a second ancillary edge 322 respectively at an upper side and a lower side, a passive segment 30 located above the sliding segment 31 with a protrusion 300 extended upwards from the sliding portion 310 and spaced from the loop forming and loosening ancillary segment 32, preferably extended upwards from another side of the sliding portion 310, and an indented abrasion-reducing space 33 located at a lateral side of the sliding portion 310 and below the loop forming and loosening ancillary segment 32. The sinker 3 also has a threshold edge 323 at a boundary between a lower side of the loop forming and loosening ancillary segment and an upper side of the abrasion-reducing space 33. In addition, the protrusion 300 has a shrunk guiding side 301 opposing to one lateral side of the loop forming and loosening ancillary segment 32, and the loop forming and loosening ancillary segment 32 has an extended guiding side 302 opposing to one lateral side of the protrusion 300. The sinker thus formed can reduce wearing and improve the performance of the mechanism and the lifespan thereof.

Figure 6:
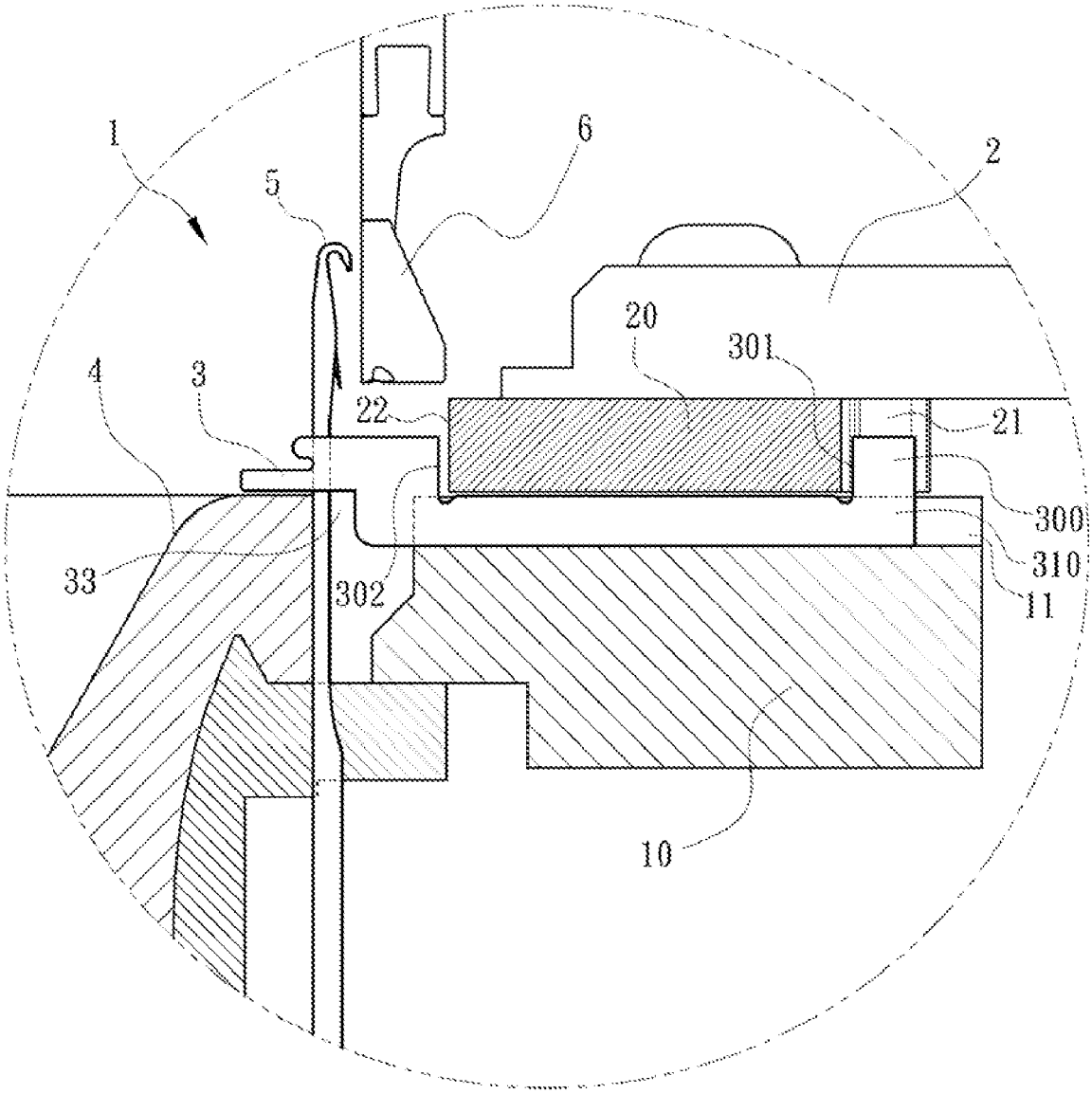
FIG. 6 is a schematic view of the sinker according to FIG. 5 in an operating condition.

Please refer to FIGS. 4 through 6 for operating conditions of the loop forming and loosening mechanism 1. First, referring to FIG. 5, during operation of the loop forming and loosening mechanism 1, the sinker 3 incorporates with the needle 5 to move horizontally and reciprocally as shown in FIGS. 5 and 6. As the indented abrasion-reducing space 33 is formed below the loop forming and loosening ancillary segment 32, the loop forming and loosening ancillary segment 32 not only can aid the loops in forming and loosening, but also can greatly reduce abrasion of the sinker. Thus the performance of the mechanism improves and the lifespan of the sinker also can be enhanced.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A loop forming and loosening mechanism for circular knitting machines, comprising:

a needle cylinder holding a plurality of needles located vertically;

a sinker tray which is located at the circumference of the needle cylinder and includes a plurality of horizontal sinker grooves each holding a sinker; and a cam holder located above the sinkers to hold a plurality of cams, each cam including a first guide track and a second guide track to drive the sinker moving horizontally;

wherein the sinker includes:

a sliding segment including a sliding portion slidably located in the sinker groove;

a loop forming and loosening ancillary segment extended upwards from one side of the sliding portion and then extended outwards and including a yarn pressing notch indented horizontally to assist the needle in loop forming and loosening, the yarn pressing notch including a first ancillary edge and a second ancillary edge respectively at an upper side and a lower side;

a passive segment which is located above the sliding segment and driven by the cam and includes a protrusion extended upwards from the sliding portion and spaced from the loop forming and loosening ancillary segment; and an indented abrasion-reducing space which is located at one side of the sliding portion and below the loop forming and loosening ancillary segment such that the loop forming and loosening ancillary segment is movable directly and horizontally above the needle cylinder.

2. The loop forming and loosening mechanism of claim 1, wherein the sinker further includes a threshold edge at a boundary between a lower side of the loop forming and loosening ancillary segment and an upper side of the abrasion-reducing space and spaced from the needle cylinder by a gap.

3. The loop forming and loosening mechanism of claim 1, wherein the protrusion includes a shrunk guiding side opposing to one lateral side of the loop forming and loosening ancillary segment and the loop forming and loosening ancillary segment includes an extended guiding side opposing to one lateral side of the protrusion, the first guide track facing the shrunk guiding side, the second guide track facing the extended guiding side.

4. The loop forming and loosening mechanism of claim 2, wherein the protrusion includes a shrunk guiding side opposing to one lateral side of the loop forming and loosening ancillary segment and the loop forming and loosening ancillary segment includes an extended guiding side opposing to one lateral side of the protrusion, the first guide track facing the shrunk guiding side, the second guide track facing the extended guiding side.

5. The loop forming and loosening mechanism of claim 1 further including a yarn feeding aperture suspended above the sinkers which are located between the needles and the cam holder.

6. The loop forming and loosening mechanism of claim 2 further including a yarn feeding aperture suspended above the sinkers which are located between the needles and the cam holder.

7. The loop forming and loosening mechanism of claim 3 further including a yarn feeding aperture suspended above the sinkers which are located between the needles and the cam holder.

8. The loop forming and loosening mechanism of claim 4 further including a yarn feeding aperture suspended above the sinkers which are located between the needles and the cam holder.

9. A sinker for circular knitting machines, comprising:

a sliding segment including a sliding portion;

a loop forming and loosening ancillary segment extended upwards from one side of the sliding portion and then extended outwards and including a yarn pressing notch indented horizontally that includes a first ancillary edge and a second ancillary edge respectively at an upper side and a lower side;

a passive segment which is located above the sliding segment and includes a protrusion extended upwards from the sliding portion and spaced from the loop forming and loosening ancillary segment; and an indented abrasion-reducing space located at a lateral side of the sliding portion and below the loop forming and loosening ancillary segment.

10. The sinker of claim 9 further including a threshold edge at a boundary between a lower side of the loop forming and loosening ancillary segment and an upper side of the abrasion-reducing space.

11. The sinker of claim 9, wherein the protrusion includes a shrunk guiding side opposing to one lateral side of the loop forming and loosening ancillary segment and the loop forming and loosening ancillary segment includes an extended guiding side opposing to one lateral side of the protrusion.

12. The sinker of claim 10, wherein the protrusion includes a shrunk guiding side opposing to one lateral side of the loop forming and loosening ancillary segment and the loop forming and loosening ancillary segment includes an extended guiding side opposing to one lateral side of the protrusion.

* * * * *